US009115910B2

(12) United States Patent
Yang et al.

(10) Patent No.: US 9,115,910 B2
(45) Date of Patent: Aug. 25, 2015

(54) FAN FILTER UNIT AND AIR PURIFICATION SYSTEM FOR DUST-FREE ROOM

(71) Applicant: SHENZHEN CHINA STAR OPTOELECTRONICS TECHNOLOGY CO., LTD, Shenzhen (CN)

(72) Inventors: Weibing Yang, Shenzhen (CN); Chunhao Wu, Shenzhen (CN); Kunhsien Lin, Shenzhen (CN); Yongqiang Wang, Shenzhen (CN); Zhiyou Shu, Shenzhen (CN); Minghu Qi, Shenzhen (CN); Zenghong Chen, Shenzhen (CN); Zhenhua Guo, Shenzhen (CN); Yunshao Jiang, Shenzhen (CN)

( * ) Notice: Subject to any disclaimer, the term of this patent is extended or adjusted under 35 U.S.C. 154(b) by 110 days.

(21) Appl. No.: 13/807,221

(22) PCT Filed: Dec. 10, 2012

(86) PCT No.: PCT/CN2012/086249

§ 371 (c)(1),
(2) Date: Dec. 27, 2012

(87) PCT Pub. No.: WO2014/067208

PCT Pub. Date: May 8, 2014

(65) Prior Publication Data

US 2014/0196419 A1 Jul. 17, 2014

(30) Foreign Application Priority Data

Oct. 30, 2012 (CN) ..... 2012 1 0424184

(51) Int. Cl.

| | |
|---|---|
| ***B01D 46/12*** | (2006.01) |
| ***B01D 46/46*** | (2006.01) |
| ***B01D 46/54*** | (2006.01) |
| ***F24F 13/28*** | (2006.01) |

(Continued)

(52) U.S. Cl.

CPC ..... *F24F 13/28* (2013.01); *F04D 29/703* (2013.01); *F24F 3/161* (2013.01); *F24F 3/1603* (2013.01)

(58) Field of Classification Search

USPC ..... 454/187, 228; 96/132, 138, 142; 414/222, 940

See application file for complete search history.

(56) References Cited

U.S. PATENT DOCUMENTS

| | | | | | |
|---|---|---|---|---|---|
| 4,699,640 | A | * | 10/1987 | Suzuki et al. | 55/385.2 |
| 4,950,316 | A | * | 8/1990 | Harris | 55/434.2 |
| 5,454,296 | A | * | 10/1995 | Beardsley et al. | 99/403 |

(Continued)

FOREIGN PATENT DOCUMENTS

| | | | |
|---|---|---|---|
| CN | 2162999 | Y | 4/1994 |
| CN | 2644743 | Y | 9/2004 |

(Continued)

OTHER PUBLICATIONS

Zhang Yu, the International Searching Authority written comments, Aug. 2013, CN.

*Primary Examiner* — Duane Smith
*Assistant Examiner* — Minh-Chau Pham

(57) ABSTRACT

A fan filter unit (FFU) includes a fan, and a filter screen coupled with an air inlet of the fan. An air inlet of the filter screen is further configured with an auxiliary filter screen, and a minimum diameter of dust particles filtrated by the auxiliary filter screen is greater than a minimum diameter of the dust particles filtrated by the filter screen.

11 Claims, 1 Drawing Sheet

(51) Int. Cl.
*F24F 3/16* (2006.01)
*F04D 29/70* (2006.01)

(56) References Cited

U.S. PATENT DOCUMENTS

| | | | | |
|---|---|---|---|---|
| 5,505,754 | A * | 4/1996 | Gasser | 55/294 |
| 6,033,301 | A * | 3/2000 | Suwa | 454/187 |
| 6,048,499 | A * | 4/2000 | Hirayama | 422/121 |
| 6,368,393 | B1 | 4/2002 | Hironaka | |
| 6,758,876 | B2 * | 7/2004 | Suzuki et al. | 55/385.6 |
| 6,869,457 | B2 * | 3/2005 | Nakagawa | 55/385.2 |
| 7,578,863 | B2 * | 8/2009 | Becker et al. | 55/495 |
| 2004/0192186 | A1 * | 9/2004 | Bourgeois et al. | 454/187 |
| 2005/0108996 | A1 * | 5/2005 | Latham et al. | 55/385.2 |
| 2005/0132677 | A1 * | 6/2005 | Bauer et al. | 55/385.2 |
| 2007/0113527 | A1 * | 5/2007 | Song et al. | 55/471 |
| 2007/0119131 | A1 * | 5/2007 | Nakano et al. | 55/385.2 |
| 2008/0182429 | A1 * | 7/2008 | Mizuno et al. | 438/787 |

FOREIGN PATENT DOCUMENTS

| | | | |
|---|---|---|---|
| CN | 1541754 | A | 11/2004 |
| CN | 201251248 | Y | 6/2009 |
| CN | 202281313 | U | 6/2012 |
| JP | S62202947 | A | 9/1987 |
| JP | H06272921 | A | 9/1994 |
| JP | 9-287791 | A | 11/1997 |
| JP | H10267338 | A | 10/1998 |
| JP | 2000-337675 | A | 12/2000 |
| JP | 2002066235 | A | 3/2002 |
| JP | 2004066111 | A | 3/2004 |
| JP | 2008107033 | A | 5/2008 |
| JP | 2009-293864 | A | 12/2009 |
| JP | 2010175099 | A | 8/2010 |

* cited by examiner

FAN FILTER UNIT AND AIR PURIFICATION SYSTEM FOR DUST-FREE ROOM

TECHNICAL FIELD

The present disclosure relates to the manufacture field of electronic products, and more particularly to a fan filter unit (FFU) and an air purification system for a dust-free room.

BACKGROUND

To prevent dust particles from affecting product quality, many electronic products are generally placed in a dust-free room to filtrate solid particle impurities such as dust in air. As shown in FIG. 1, the dust-free room is configured with fan filter units (FFUs) at a top of a factory, namely a fan is combined with a filter (high efficiency particulate air filter (HEPA)) or an ultra low penetration air filter (ULPA)) to form an end purification equipment that uses self-supplied power. Air is sucked in by the fan from the FFU top and is filtrated by the HEPA, and the filtrated air is uniformly delivered at an air speed of 0.45 m/s±20% from an air outlet surface. When the FFUs filtrate particulates in the air, large dust particulates are blocked inside the and clean air is outputted. Most of the FFUs are scrapped because of built-up of the dust particles, which requires the FFUs to be serviced frequently.

SUMMARY

In view of the above-described problems, the aim of the present disclosure is to provide a fan filter unit (FFU) and an air purification system for a dust-free room thereof capable of extending service life.

The aim of the present disclosure is achieved by the following technical scheme.

A FFU comprises a fan, and a filter screen coupled with an air inlet of the fan. An air inlet of the filter screen is further configured with an auxiliary filter screen, and a minimum diameter of dust particles filtrated by the auxiliary filter screen is greater than a minimum diameter of the dust particles filtrated by the filter screen.

Furthermore, the auxiliary filter screen is fixed to the air inlet of each of the FFUs by screw fixing or buckle fixing. Because the auxiliary filter screen filtrates large dust particles, the large dust particles are easily accumulated by the auxiliary filter screen which makes the auxiliary filter screen be cleaned frequently. The auxiliary filter screen is configured to be removable, which makes the auxiliary filter screen be cleaned easily or directly replaces a clean auxiliary filter screen without the need to stopp equipment and affect production.

An air purification system for a dust-free room comprises a factory, and fan filter units (FFUs) connected with the factory. The each of the FFUs comprises fan, and a filter screen coupled with an air inlet of the fan. An air inlet of the filter screen is further configured with an auxiliary filter screen, and a minimum diameter of dust particles filtrated by the auxiliary filter screen is greater than a minimum diameter of the dust particles filtrated by the filter screen.

Furthermore, an air condensation layer is arranged between the filter screen and the auxiliary filter screen. Condensed air is conducive to make the dust particles accumulate and separate.

Furthermore, the auxiliary filter screen is fixed to the air condensation layer by t screw fixing or buckle fixing. Because the auxiliary filter screen filtrates large dust particles, the large dust particles is easily accumulated in the auxiliary filter screen which makes the auxiliary filter screen be cleaned frequently. The auxiliary filter screen is configured to be removable, which makes the auxiliary filter screen be cleaned easily or directly replaces a clean auxiliary filter screen without the need to stop equipment and affect production.

Furthermore, an air backflow filter layer is arranged between the air condensation layer and the filter screen. The air backflow filter layer supplies air to each of the FFUs, which filtrates the dust particles.

Furthermore, a temperature control ventilation layer is arranged between an air outlet of the factory and the FHA, and the auxiliary filter screen is arranged in the temperature control ventilation layer. Because the auxiliary filter screen arranged in spacious temperature control ventilation layer, an operator can stand on a floor to replace the auxiliary filter screen.

Furthermore, an air return duct is arranged between the temperature control ventilation layer and the air backflow filter layer, and airflow of the temperature control ventilation layer is communicated with airflow of the air backflow filter layer by the air return duct. This is a specific air purification system for a dust-free room.

Furthermore, an air outlet of each of the FFUs is connected to a top of the factory, and an air inlet of each of the FFUs is connected to a floor of the factory. Because density of the dust particles is greater than density of air, the dust particles are often accumulated at the floor of the factory. Thus, airflow is removed from the floor of the factory, and simultaneously the dust particles accumulated at the floor of the factory are removed. The airflow removed from the factory enters into the FFUs, then the airflow is blown out from the top of the factory after then the airflow is filtrated by the FFUs, then the blown airflow enables suspended dust particles to quickly move to the floor of the factory and then be removed from the floor. A cyclical operation repeats, which keeps the factory to be in a dust-free state.

Furthermore, an air outlet of each of the FFUs is connected to a top of the factory, and an air inlet of the FFU is connected to a floor of the factory. A temperature control ventilation layer is arranged between an air outlet of the factory and the FFUs, and the auxiliary filter screen is arranged in the temperature control ventilation layer. An air condensation layer and an air backflow filter layer are arranged between the auxiliary filter screen and the filter screen in sequence, and the auxiliary filter screen is fixed to the air condensation layer by screw fixing or buckle fixing. An air return duct is arranged between the temperature control ventilation layer and the air backflow filter layer, and airflow of the temperature control ventilation layer is communicated with airflow of the air backflow filter layer by the air return duct. The auxiliary filter screen is configured to be removable. This is a specific air purification system for a dust-free room.

The inventor finds by research that when the dust particles enter into ventilating ducts, in the filter screen, large dust particles are deposited first, and then small dust particles are stuck to surfaces of the large dust particles. Thus, the dust particles is accumulated layer by layer, and then the ventilating ducts and the filter screen are quickly blocked, which shortens service life of the FFUs and the air purification system for a dust-free room. In the present disclosure, the auxiliary filter screen is used, and the large dust particles are filtrated. The dust particles entering into the ventilating ducts and the filter screen are reduced, and dust particles entering the ventilating ducts and the filter screen are small and are not easy to be deposited, thus, which makes the ventilating ducts be unblocked. Therefore, only the auxiliary filter screen need to be periodically replaced while in use. By using double filtration, the lager dust particles and the small dust particles are separately filtrated, filtration efficiency and the service life of each of the FFUs is increased, replacement frequency and difficulty of the filter system are reduced, consumable cost of each of the FFUs is reduced, and the service life of the air purification system for the dust-free room is increased.

DETAILED DESCRIPTION

The present disclosure provides an air purification system for a dust-free room. The air purification system for a dust-free room comprises a factory, and fan filter units (FFUs) connected with the factory. Each of the FFUs comprises a fan, and a filter screen coupled with an air inlet of the fan. An air inlet of the filter screen is further configured with an auxiliary filter screen, were a minimum diameter of dust particles filtrated by the auxiliary filter screen is greater than a minimum diameter of dust particles filtrated by the filter screen.

The inventor finds by research that when the dust particles enter into ventilating ducts, in the filter screen, large dust particles are deposited first, and then small dust particles are stuck to surfaces of the large dust particles. Thus, the dust particles is accumulated layer by layer which makes the filter screen be quickly blocked, and shortens service life of each of the FFUs and the air purification system for the dust-free room. In the present disclosure, the auxiliary filter screen is used, where the large dust particles are filtrated first. The dust particles entering into the ventilating ducts and the filter screen are reduced, and the dust particles entering the ventilating ducts and the filter screen are small and are not easy to be deposited, thus, which makes the ventilating ducts to not be blocked. Therefore, only the auxiliary filter screen needs to be periodically replaced while in use. By using double filtration, the larger dust particles and the small dust particles are separately filtrated, filtration efficiency and the service life of each of the FFUs is increased, replacement frequency and difficulty of the filter system are reduced, consumable cost of each of the FFUs is reduced, and the service life of the air purification system for the dust-free room is increased.

Figure 1:
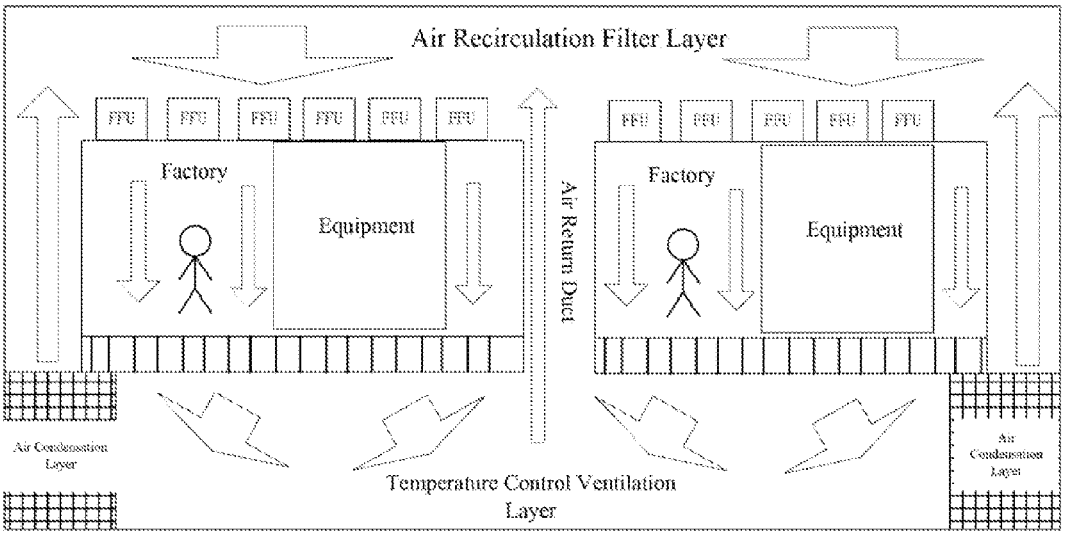
FIG. 1 PRIOR ART
FIG. 1 is a schematic diagram of a typical air purification system for a dust-free room.
Figure 2:
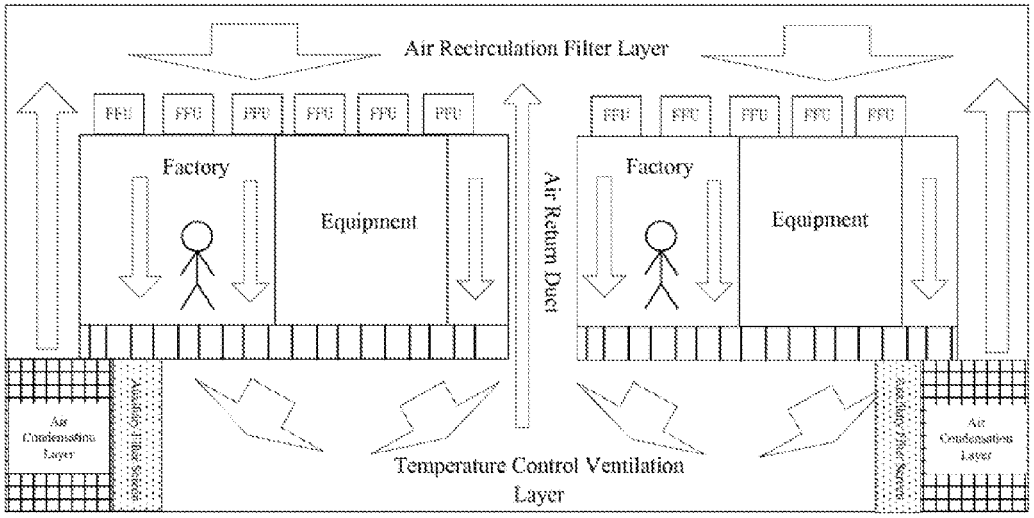
FIG. 2 is a schematic diagram of a typical air purification system for a dust-free room of an example of the present disclosure.

As shown in FIG. 2, a center of the air purification system for the dust-free room is a factory, where work is done inside the factory, workers frequently go in and out, all kinds of equipment operate in the factory, which is a main source of the dust particles of the dust-free room. The air outlet of each of the FFUs is connected to a top of the factory, and the air inlet of each of the FFU is connected to a floor of the factory. Because density of dust particles is greater than density of air, the dust particles is often accumulated at the floor of the factory. Thus, airflow is removed from the floor of the factory, and simultaneously the dust particles accumulated at the floor of the factory are removed. The airflow removed from the factory enters into the FFUs, then the airflow is blown out from the top of the factory after the airflow is filtrated by the FFUs, the blown airflow enables suspended dust particles to quickly move to the floor of the factory and then be removed from the floor of the factory. A cyclical operation repeats, which keeps the factory to be in a dust-free state.

A temperature control ventilation layer is arranged between an air outlet of the factory and the FFUs, and the auxiliary filter screen is fixed to the temperature control ventilation layer. An air condensation layer and an air backflow filter layer are arranged between the auxiliary filter screen and the filter screen in sequence. Condensed air is conducive to make dust particles accumulate and separate. The air backflow filter layer supplies air to each of the FFUs, and can filtrate the dust particles.

An air return duct is arranged between the temperature control ventilation layer and the air backflow filter layer, and the airflow of the temperature control ventilation layer is communicated with the airflow of the air backflow filter layer via the air return duct.

The auxiliary filter screen is arranged in the temperature control ventilation layer, and is fixed to the air condensation layer by a removable mode such as screw fixing or buckle fixing. Because the auxiliary filter screen filtrates large dust particles, the large dust particles are easily accumulated by the auxiliary filter screen, and then the auxiliary filter screen is cleaned frequently. The auxiliary filter screen is configured to be removable, which makes the auxiliary filter screen be cleaned easily or directly replaces a clean auxiliary filter screen without the need to stop equipment and affect production. Because the temperature control ventilation layer is adjacent to the factory, an operator can stand on the floor to replace the auxiliary filter screen.

The present disclosure is described, in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

The invention claimed is:

1. An air purification system for a dust-free room, comprising:

a factory, and fan filter units (FFUs) connected with the factory;

wherein each of the FFUs comprises a fan, and a filter screen coupled with an air inlet of the fan; an air inlet of the filter screen is further configured with an auxiliary filter screen, and a minimum diameter of dust particles filtrated by the auxiliary filter screen is greater than a minimum diameter of the dust particles filtrated by the filter screen, wherein an air condensation layer is arranged between the filter screen and the auxiliary filter screen, wherein an air outlet of each of the FFUs is connected to a top of the factory, and an air inlet of each of the FFUs is connected to a floor of the factory; a temperature control ventilation layer is arranged between an air outlet of the factory and the FFUs, and the auxiliary filter screen is arranged in the temperature control ventilation layer; the air condensation layer and an air backflow filter layer are arranged between the auxiliary filter screen and the filter screen in sequence, and the auxiliary filter screen is fixed to the air condensation layer by screw fixing or buckle fixing; an air return duct is arranged between the temperature control ventilation layer and the air backflow filter layer, and airflow of the temperature control ventilation layer is communicated with airflow of the air backflow filter layer by the air return duct; the auxiliary filter screen is configured to be removable.

2. The air purification system for a dust-free room of claim 1, wherein an air outlet of each of the FFUs is connected to a top of the factory and an air inlet of each of the FFUs is connected to a floor of the factory.

3. The air purification system for a dust-free room of claim 1, wherein the auxiliary filter screen is fixed to the air condensation layer by screw fixing or buckle fixing.

4. The air purification system for a dust-free room of claim 3, wherein an air outlet of each of the FFUs is connected to a top of the factory and an air inlet of each of the FFUs is connected to a floor of the factory.

5. An air purification system for a dust-free room comprising:

a factory; and fan filter units (FFUs) connected with the factory;

wherein each of the FFUs comprises a fan, and a filter screen coupled with an air inlet of the fan; an air inlet of the filter screen is further configured with an auxiliary filter screen, and a minimum diameter of dust particles filtrated by the auxiliary filter screen is greater than a minimum diameter of the dust particles filtrated by the filter screen, wherein an air condensation layer is arranged between the filter screen and the auxiliary filter screen, wherein the auxiliary filter screen is fixed to the air condensation layer by screw fixing or buckle fixing, wherein an air backflow filter layer is arranged between the air condensation layer and the filter screen.

6. The air purification system for a dust-free room of claim 5, wherein an air outlet of the each of the FFUs is connected to a top of the factory and an air inlet of each of the FFUs is connected to a floor of the factory.

7. The air purification system for a dust-free room of claim 5, wherein a temperature control ventilation layer is arranged between an air outlet of the factory and the FFUs, and the auxiliary filter screen is arranged in the temperature control ventilation layer.

8. The air purification system for a dust-free room of claim 7, wherein an air outlet of each of the FFUs is connected to a top of the factory and an air inlet of each of the FFUs is connected to a floor of the factory.

9. The air purification system for a dust-free room of claim 7, wherein an air return duct is arranged between the temperature control ventilation layer and the air backflow filter layer, and airflow of the temperature control ventilation layer is communicated with airflow of the air backflow filter layer by the air return duct.

10. The air purification system for a dust-free room of claim 9, wherein an air outlet of each of the FFUs) is connected to a top of the factory, and an air inlet of each of the FFUs is connected to a floor of the factory.

11. The air purification system for a dust-free room of claim 1, wherein the air condensation layer is configured for condensing air thereby conducive to make dust particles accumulate and separate.

* * * * *